US006864030B2

(12) United States Patent
Shirai et al.

(10) Patent No.: US 6,864,030 B2
(45) Date of Patent: Mar. 8, 2005

(54) TONER

(75) Inventors: Eiji Shirai, Wakayama (JP); Masayuki Maruta, Wakayama (JP); Katsutoshi Aoki, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 10/255,575

(22) Filed: Sep. 27, 2002

(65) Prior Publication Data

US 2003/0118929 A1 Jun. 26, 2003

(30) Foreign Application Priority Data

Sep. 27, 2001 (JP) ..... 2001-297872

(51) Int. Cl.[7] ..... G03G 9/087

(52) U.S. Cl. ..... 430/109.4; 430/108.1; 430/108.7

(58) Field of Search ..... 430/109.4, 108.1, 430/108.7

(56) References Cited

U.S. PATENT DOCUMENTS 6,383,705 B2 5/2002 Aoki et al.
6,420,079 B1 * 7/2002 Morinishi et al. ..... 430/108.6

FOREIGN PATENT DOCUMENTS

| | | | |
|---|---|---|---|
| JP | 87039428 | B | 8/1987 |
| JP | 62-246073 | A | 10/1987 |
| JP | 62-289850 | A | 12/1987 |
| JP | 62-289851 | A | 12/1987 |
| JP | 93044032 | B | 7/1993 |
| JP | 5-333590 | A | 12/1993 |
| JP | 6-348057 | A | 12/1994 |
| JP | 8-15899 | A | 1/1996 |
| JP | 8-36316 | A | 2/1996 |
| JP | 8-227225 | A | 9/1996 |
| JP | 10-20539 | A | 1/1998 |
| JP | 11-202539 | A | 7/1999 |
| JP | 11249339 | A | 9/1999 |
| JP | 2000-19918 | A | 1/2000 |
| JP | 2001-242660 | A | 9/2000 |
| JP | 2001-66821 | A | 3/2001 |
| JP | 2001222138 | A | 8/2001 |

OTHER PUBLICATIONS

Brochure of AEROSIL.

* cited by examiner

*Primary Examiner*—John L Goodrow
(74) *Attorney, Agent, or Firm*—Birch, Stewart, Kolasch & Birch, LLP

(57) ABSTRACT

A toner comprising a resin binder comprising a crystalline resin; a colorant; and fine inorganic particles, the fine inorganic particles being externally added thereto, wherein a coating ratio of the fine inorganic particles on a surface of the toner is 130 to 300%. The toner can be suitably used for developing electrostatic latent images formed in electrophotography, electrostatic recording method, electrostatic printing method and the like.

13 Claims, No Drawings

TONER

This nonprovisional application claims priority under 35 U.S.C. § 119 (a) on Patent Application No. 2001-297872 filed in JAPAN on Sep. 27, 2001, which is herein incorporated by reference.

BACKGROUND OF THE INVENTION

1. Field of the Invention

The present invention relates to a toner used for developing electrostatic latent images formed in electrophotography, electrostatic recording method, electrostatic printing method and the like, preferably in electrophotography.

2. Discussion of the Related Art

In order to improve low-temperature fixing ability, which is one of the major problems to be solved in electrophotography, a toner comprising a resin binder comprising a crystalline polyester has been proposed (Japanese Examined Patent Publication No. Hei 5-44032, Japanese Examined Patent Publication No. Sho 62-39428 and the like). However, there is a problem in that the storage stability is lowered due to the plasticizing effect with the resin and various additives.

Therefore, the use of a crystalline polyester together with an amorphous polyester has been proposed (Japanese Patent Laid-Open No. 2001-222138 (U.S. Pat. No. 6,383,705) and Japanese Patent Laid-Open No. Hei 11-249339). Although the storage stability and the low-temperature fixing ability are found to be improved to some extent, there has been earnestly desired a toner which can give a higher-quality image without the image fogging.

An object of the present invention is to provide a toner which comprises a resin binder comprising a crystalline resin, the toner being excellent in the storage property and the low-temperature fixing ability, and giving a high-quality image without the image fogging.

These and other objects of the present invention will be apparent from the following description.

SUMMARY OF THE INVENTION

The present inventors have found that the storage stability of the toner comprising a crystalline resin is improved by external addition of a large amount of fine inorganic particles, and perfected the present invention.

Specifically, the present invention relates to a toner comprising:

a resin binder comprising a resin having a ratio of a softening point to a maximal peak temperature of heat of fusion of 0.6 or more and less than 1.1 (hereinafter referred to as "crystalline resin");

a colorant; and fine inorganic particles, the fine inorganic particles being externally added thereto, wherein a coating ratio of the fine inorganic particles on a surface of the toner is 130 to 300%.

DETAILED DESCRIPTION OF THE INVENTION

One of the features of the toner of the present invention resides in that a large amount of fine inorganic particles are externally added to the surface of the toner. Generally, in a toner which does not contain a crystalline resin as a resin binder, when an external additive is added to excess, free fine inorganic particles are increased, so that the adhesion strength of the toner onto an adherend such as paper is lowered. As a result, not only the low-temperature fixing ability is worsened, but also the frictional force between the toner and the carrier or the like is also lowered, thereby causing image fogging. However, in the toner comprising a crystalline resin of the present invention, even when an external additive is added to excess, the low-temperature fixing ability and the image fogging are not adversely affected, and lowering in the storage property caused by a crystalline resin is suppressed. The reason why such effects of the present invention are exhibited is unclear. However, it is presumed that an appropriate adhesion strength to an adherend and an appropriate friction property between the toner and the carrier or the charging blade are maintained because there is a strong interaction between the crystalline resin and the fine inorganic particles, thereby suppressing freeing of an external additive, though the fine inorganic particles are adhered in two or more layers onto the whole surface or a part of the surface of the toner of the present invention.

It is preferable that the toner of the present invention further comprises a resin having a ratio of a softening point to a maximal peak temperature of heat of fusion of from 1.1 to 4.0 (hereinafter referred to as "amorphous resin") as a resin binder.

The content of the crystalline resin is preferably from 1 to 40% by weight, more preferably from 5 to 35% by weight, especially preferably from 10 to 30% by weight, of the resin binder from the viewpoints of the storage property and the low-temperature fixing ability. In addition, the weight ratio of the crystalline resin to the amorphous resin, crystalline resin/amorphous resin, is preferably from 1/99 to 40/60, more preferably from 5/95 to 35/65, still more preferably from 10/90 to 30/70.

The crystalline resin includes crystalline polyesters, crystalline polyester-polyamides, crystalline styrene-acrylic resins, crystalline hybrid resins in which two or more resin components including at least one crystalline resin component are partially chemically bonded to each other, and the like. Among them, from the viewpoints of the fixing ability and the compatibility with the amorphous resin, the crystalline polyesters and the crystalline hybrid resins are preferable, and the crystalline polyesters are more preferable.

In the present invention, the crystalline polyester is preferably a resin obtained by polycondensing an alcohol component comprising 80% by mol or more of an aliphatic diol having 2 to 6 carbon atoms, preferably 4 to 6 carbon atoms, with a carboxylic acid component comprising 80% by mol or more of an aliphatic dicarboxylic acid compound having 2 to 8 carbon atoms, more preferably 4 to 6 carbon atoms, more preferably 4 carbon atoms.

The aliphatic diol having 2 to 6 carbon atoms includes ethylene glycol, 1,2-propylene glycol, 1,3-propylene glycol, 1,4-butanediol, 1,5-pentanediol, 1,6-hexanediol, neopentyl glycol, 1,4-butenediol, and the like. Among them, α, ω-linear alkane diol is preferable, and 1,4-butanediol and 1,6-hexanediol are more preferable.

It is desirable that the aliphatic diols having 2 to 6 carbon atoms are contained in the alcohol component in an amount of 80% by mol or more, preferably from 85 to 100% by mol, more preferably from 90 to 100% by mol. Especially, it is desirable that one of the aliphatic diols constitutes 70% by mol or more, preferably 80% by mol or more, more preferably from 85 to 95% by mol of the alcohol component.

The alcohol component may comprise a polyhydric alcohol component other than the aliphatic diol having 2 to 6 carbon atoms. The polyhydric alcohol component includes dihydric aromatic alcohols such as alkylene(2 or 3 carbon atoms) oxide(average number of moles: 1 to 10) adducts of bisphenol A such as polyoxypropylene(2.2)-2,2-bis(4-hydroxyphenyl)propane and polyoxyethylene(2.2)-2,2-bis(4-hydroxyphenyl)propane; and trihydric or higher polyhydric alcohols such as glycerol, pentaerythritol and trimethylolpropane.

The aliphatic dicarboxylic acid compound having 2 to 8 carbon atoms includes oxalic acid, malonic acid, maleic acid, fumaric acid, citraconic acid, itaconic acid, glutaconic acid, succinic acid, adipic acid, acid anhydrides thereof, alkyl(1 to 3 carbon atoms) esters thereof, and the like. Among them, fumaric acid is preferable. Incidentally, as described above, the aliphatic dicarboxylic acid compound refers to aliphatic dicarboxylic acids, acid anhydrides thereof and alkyl(1 to 3 carbon atoms) esters thereof, among which the aliphatic dicarboxylic acids are preferable.

It is desirable that the aliphatic dicarboxylic acid compounds having 2 to 8 carbon atoms are contained in the carboxylic acid component in an amount of 80% by mol or more, preferably from 85 to 100% by mol, more preferably from 90 to 100% by mol. Especially, it is desirable that one of the aliphatic dicarboxylic acid compounds constitutes 60% by mol or more, preferably from 80 to 100% by mol, more preferably from 90 to 100% by mol, of the carboxylic acid component. Above all, it is desirable that fumaric acid constitutes preferably 60% by mol or more, more preferably from 70 to 100% by mol, especially preferably from 80 to 100% by mol, of the carboxylic acid component, from the viewpoint of the storage property of the crystalline polyester.

The carboxylic acid component may comprise a polycarboxylic acid component other than the aliphatic dicarboxylic acid compound having 2 to 8 carbon atoms. The polycarboxylic acid component includes aromatic dicarboxylic acids such as phthalic acid, isophthalic acid and terephthalic acid; aliphatic dicarboxylic acids such as sebacic acid, azelaic acid, n-dodecylsuccinic acid and n-dodecenylsuccinic acid; alicyclic dicarboxylic acids such as cyclohexanedicarboxylic acid; tricarboxylic or higher polycarboxylic acids such as 1,2,4-benzenetricarboxylic acid (trimellitic acid) and pyromellitic acid; acid anhydrides thereof, alkyl(1 to 3 carbon atoms) esters thereof, and the like.

The polycondensation of the alcohol component with the carboxylic acid component can be carried out, for instance, by the reaction at a temperature of from 120° to 230° C. in an inert gas atmosphere, using an esterification catalyst, a polymerization inhibitor and the like as occasion demands. Concretely, in order to enhance the strength of the resin, the entire monomers may be charged at once. Alternatively, in order to reduce the low-molecular weight components, divalent monomers are firstly reacted, and thereafter trivalent or higher polyvalent monomers are added and reacted. In addition, the reaction may be promoted by reducing the pressure of the reaction system in the second half of the polymerization.

Here, in the present invention, the term "crystalline" means that a ratio of the softening point to the maximum peak temperature of heat of fusion (softening point/maximum peak temperature of heat of fusion) is from 0.6 or more and less than 1.1, preferably from 0.9 or more and less than 1.1, more preferably from 0.98 to 1.05. Also, the term "amorphous" means that a ratio of the softening point to the maximum peak temperature of heat of fusion (softening point/maximum peak temperature of heat of fusion) is from 1.1 to 4.0, preferably from 1.5 to 3.0.

The crystalline polyester has a softening point of preferably from 85° to 150° C., more preferably from 90° to 140° C., especially preferably from 100° to 135° C. The crystalline polyester has a maximum peak temperature of heat of fusion of preferably from 77° to 166° C., more preferably from 82° to 155° C., especially preferably from 91° to 150° C.

Incidentally, in the case where the crystalline polyester comprises two or more resins, it is desirable that at least one of them, preferably all of them, is the crystalline polyester described above.

The crystalline hybrid resin is preferably a resin comprising a crystalline polyester resin component as a crystalline resin component. Incidentally, in the present invention, regardless of being crystalline or amorphous, the hybrid resin is preferably a resin obtained by mixing a mixture of raw material monomers for two polymerization resins each having an independent reaction path, preferably a mixture of raw material monomers for a condensation polymerization resin, especially preferably a polyester, and raw material monomers for an addition polymerization resin, especially preferably a vinyl resin, preferably with a monomer, as one of the raw material monomers, which is capable of reacting with both of the above raw material monomers for the above two polymerization resins (dually reactive monomer), for instance, (meth)acrylic acid, to carry out the two polymerization reactions. Here, in the case of the crystalline hybrid resin, raw material monomers for at least one crystalline resin, preferably raw material monomers for a crystalline polyester, are used during the preparation.

The amorphous resin includes amorphous polyesters, amorphous polyester-polyamides, amorphous styrene-acrylic resins, amorphous hybrid resins and the like. Among them, from the viewpoints of the fixing ability and the compatibility with the crystalline resin, the amorphous polyesters and the amorphous hybrid resins are preferable, and the amorphous polyesters are more preferable.

The raw material monomers for the amorphous polyester are exemplified by the same polyhydric alcohol component, and the same polycarboxylic acid component such as carboxylic acids, carboxylic acid anhydrides and esters of carboxylic acids, as in the raw material monomers for the crystalline polyester. The amorphous polyester is obtained by polycondensing these components.

Incidentally, it is preferable that the amorphous polyester is either one of the following resins:

1) in a case where monomers for accelerating crystallization of a resin, such as an aliphatic diol having 2 to 6 carbon atoms and an aliphatic dicarboxylic compound having 2 to 8 carbon atoms, are used, a resin in which crystallization is suppressed by using two or more of these monomers in combination, in each of the alcohol component and the carboxylic acid component, at least one of these monomers is used in an amount of from 10 to 70% by mol, preferably 20 to 60% by mol of each component, and these monomers are used in two or more kinds, preferably two to four kinds; or
2) a resin obtained from monomers for accelerating amorphousness of a resin, preferably an alkylene oxide adduct of bisphenol A as an alcohol component, or a substituted succinic acid of which substituent is an alkyl group or alkenyl group as a carboxylic acid component, wherein the monomers are contained in an amount of from 30 to 100% by mol, preferably from 50 to 100% by mol, of the alcohol component or the carboxylic acid component, preferably of the alcohol component and the carboxylic acid component, respectively.

The amorphous polyester can be prepared in the same manner as in the crystalline polyester.

The amorphous hybrid resin can be prepared in the same manner as in the crystalline hybrid resin except that raw material monomers for an amorphous resin are used as the raw material monomers.

The amorphous resin has a softening point of preferably from 80° to 170° C., more preferably from 90° to 130° C., especially preferably from 95° to 120° C. The amorphous resin has a maximum peak temperature of heat of fusion of preferably from 50° to 85° C., more preferably from 60° to 75° C., a glass transition point of preferably from 45° to 80° C., more preferably from 55° to 75° C., and a weight percentage of component insoluble to THF of preferably from 0 to 50% by weight. Incidentally, glass transition point is a property intrinsically owned by an amorphous resin, and is distinguished from the maximum peak temperature of heat of fusion.

Incidentally, in the case where the amorphous resin comprises two or more resins, it is desirable that at least one of them, preferably all of them, is the amorphous resin having the properties described above.

The content of the crystalline polyester is preferably from 1 to 40% by weight, more preferably from 5 to 35% by weight, especially preferably from 10 to 30% by weight, of the resin binder, from the viewpoints of the storage property and the low-temperature fixing ability. In addition, the weight ratio of the crystalline polyester to the amorphous resin, crystalline polyester/amorphous resin, is preferably from 1/99 to 40/60, more preferably from 5/95 to 35/65, still more preferably from 10/90 to 30/70.

As the colorants, all of the dyes, pigments and the like which are used as colorants for toners can be used, and the colorant includes black colorants such as carbon blacks and composite oxides of metals; colored colorants such as Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, disazoyellow. These colorants can be used alone or in admixture of two or more kinds. In the present invention, the toner may be any of black toner, color toner and full-color toner. The content of the colorant is preferably from 1 to 40 parts by weight, more preferably from 3 to 10 parts by weight, based on 100 parts by weight of the resin binder.

The external additives include fine inorganic particles made of silica, alumina, titania, zirconia, tin oxide, zinc oxide or the like. Among them, it is preferable that silica having a small specific gravity is contained from the viewpoint of prevention of the embedment of the external additive.

The silica is preferably a hydrophobic silica which is previously hydrophobically treated, from the viewpoint of the stability in environmental resistance. The method of hydrophobic treatment of the silica is not particularly limited. The agent for hydrophobic treatment includes hexamethyldisilazane, dimethyldichlorosilane, silicone oil, methyltriethoxysilane, and the like. Among them, hexamethyldisilazane is preferable. It is preferable that the amount of the agent for hydrophobic treatment is from 1 to 7 $mg/m^2$ per surface area of the silica.

The fine inorganic particles have an average particle size of preferably from 6 to 200 nm, more preferably from 7 to 100 nm, especially preferably from 8 to 50 nm, from the viewpoints of the fluidity and the protection of the photoconductor and the like.

It is desirable that the coating ratio of the toner with the fine inorganic particles is from 130 to 300%, preferably from 150 to 250%, more preferably from 170 to 230%. When the coating ratio is too low, the storage property is lowered. On the other hand, when the coating ratio is too high, the fixing ability is lowered, thereby causing the image fogging.

In the present invention, the coating ratio (f) of the toner with the fine inorganic particles is calculated by the following equation:

$$f(\%)=\sqrt{3}/2\pi\times(D\cdot\rho\tau)/(d\cdot\rho s)\times C\times 100$$

wherein d is an average particle size of fine inorganic particles;

D is a number-average particle size of an untreated toner; $\rho\tau$ and $\rho s$ are a true specific gravity of an untreated toner and a true specific gravity of fine inorganic particles, respectively; and C is a weight ratio of fine inorganic particles to an untreated toner.

Incidentally, in the case where the fine inorganic particles comprise two or more kinds of fine inorganic particles having different average particle sizes, the coating ratio (f) of a toner as a whole is the sum of the coating ratios of the respective fine inorganic particles. For example, in the case where fine inorganic particles (1) and fine inorganic particles (2) are externally added, the coating ratio (f) of the toner as a whole is $f_1+f_2$ wherein the coating ratios of the fine inorganic particles (1) and the fine inorganic particles (2) are $f_1$ and $f_2$, respectively.

The content of the fine inorganic particles is appropriately determined based on the coating ratio of the toner. As one measure, the content is preferably from 0.7 to 5 parts by weight or so, more preferably from 1 to 3 parts by weight or so, especially preferably from 1.1 to 2.7 parts by weight or so, based on 100 parts by weight of the toner before external addition of fine inorganic particles (untreated toner).

Further, the toner of the present invention may appropriately contain an additive such as a charge control agent, a releasing agent, an electric conductivity modifier, an extender, a reinforcing filler such as a fibrous substance, an antioxidant, an anti-aging agent, a fluidity improver, and a cleanability improver.

The charge control agent includes positively chargeable charge control agents such as Nigrosine dyes, triphenylmethane-based dyes containing a tertiary amine as a side chain, quaternary ammonium salt compounds, polyamine resins and imidazole derivatives, and negatively chargeable charge control agents such as metal-containing azo dyes, copper phthalocyanine dyes, metal complexes of alkyl derivatives of salicylic acid and boron complexes of benzilic acid.

The releasing agent includes waxes such as natural ester waxes such as carnauba wax and rice wax; synthetic waxes such as polypropylene wax, polyethylene wax and Fischer-Tropsch wax; petroleum waxes such as montan wax, alcohol waxes. These waxes may be contained alone or in admixture of two or more kinds.

The toner in the present invention can be prepared by a surface treatment step comprising mixing an untreated toner with an external additive using a Henschel mixer or the like. The untreated toner is preferably a pulverized toner, and obtained by, for instance, homogeneously mixing a resin binder, a colorant and the like in a mixer such as a Henschel mixer or a ball-mill, thereafter melt-kneading with a closed kneader, a single-screw or twin-screw extruder, or the like, cooling, roughly pulverizing the resulting product using a hammer-mill, and further finely pulverizing with a fine pulverizer utilizing a jet stream or a mechanical pulverizer, and classifying the pulverized product to a given particle size with a classifier utilizing rotary stream or a classifier utilizing Coanda effect. The toner has a number-average particle size of preferably from 3 to 15 μm.

The toner of the present invention can be used alone as a developer, in a case where the fine magnetic material powder is contained. Alternatively, in a case where the fine magnetic material powder is not contained, the toner may be used as a nonmagnetic one-component developer, or the toner can be mixed with a carrier and used as a two-component developer.

EXAMPLES

[Softening Point]

Softening point refers to a temperature corresponding to ½ of the height (h) of the S-shaped curve showing the relationship between the downward movement of a plunger of flow tester (flow length) and temperature, namely, a temperature at which a half of the resin flows out, when measured by using a flow tester of the "koka" type ("CFT-500D," commercially available from Shimadzu Corporation) in which a 1 g sample is extruded through a nozzle having a dice pore size of 1 mm and a length of 1 mm, while heating the sample so as to raise the temperature at a rate of 6° C./min and applying a load of 1.96 MPa thereto with the plunger.

[Maximum Peak Temperature of Heat of Fusion and Glass Transition Point]

The maximum peak temperature of heat of fusion is determined using a differential scanning calorimeter ("DSC Model 210," commercially available from Seiko Instruments, Inc.), by raising its temperature to 200° C., cooling the hot sample from this temperature to 0° C. at a cooling rate of 10° C./min., and thereafter heating the sample so as to raise the temperature at a rate of 10° C./min. In addition, the glass transition point refers to the temperature of an intersection of the extension of the baseline of equal to or lower than the maximum peak temperature and the tangential line showing the maximum inclination between the kickoff of the peak and the top of the peak by the determination mentioned above.

[Number-Average Particle Size of Toner]

Measuring Apparatus: Coulter Multisizer II (commercially available from Beckman Coulter)

Aperture Diameter: 100 μm

Analyzing Software: Coulter Multisizer AccuComp Ver. 1.19 (commercially available from Beckman Coulter)

Electrolyte: Isotone II (commercially available from Beckman Coulter)

Dispersion: 5% electrolyte of EMULGEN 109P (commercially available from Kao Corporation, polyoxyethylene lauryl ether, HLB: 13.6)

Dispersing Conditions: Ten milligrams of a test sample is added to 5 ml of a dispersion, and the resulting mixture is dispersed in an ultrasonic disperser for 1 minute. Thereafter, 25 ml of an electrolyte is added to the dispersion, and the resulting mixture is dispersed in an ultrasonic dispersing apparatus for another 1 minute.

Measurement Conditions: One-hundred milliliters of an electrolyte and a dispersion are added to a beaker, and the particle sizes of the particles are determined for 20 seconds under the conditions for concentration satisfying that the determination for 30000 particles are completed in 20 seconds to obtain its number-average particle size.

Preparation Example of Crystalline Polyester

The raw material monomers as shown in Table 1 and 2 g of hydroquinone were reacted under nitrogen gas atmosphere at 160° C. for 5 hours. Thereafter, the temperature was raised to 200° C., and the ingredients were reacted for 1 hour, and further reacted at 8.3 kPa for 1 hour. The resulting resin is referred to as Resin a.

TABLE 1

| | Resin a |
|---|---|
| 1,4-Butanediol | 1013 g (90) |
| 1,6-Hexanediol | 143 g (10) |
| Fumaric Acid | 1450 g (100) |
| Softening Point (° C.) | 122.0 |
| Maximum Peak Temperature (° C.) of Heat of Fusion | 124.6 |

Note) The amounts in parentheses are expressed by a molar ratio in the alcohol component or the carboxylic acid component.

Preparation Examples of Amorphous Resin (i) The raw material monomers as shown in Table 2 and 4 g of dibutyltin oxide were reacted under nitrogen gas atmosphere at 220° C. for 8 hours. Thereafter, the ingredients were further reacted at 8.3 kPa until the desired softening point was reached. The resulting resin is referred to as Resin A.

(ii) The raw material monomers as shown in Table 2 and 4 g of dibutyltin oxide were reacted under nitrogen gas atmosphere, with raising the temperature from 180° to 210° C. for 8 hours. Thereafter, the ingredients were further reacted at 8.3 kPa until the desired softening point was reached. The resulting resin is referred to as Resin B.

TABLE 2

| | Resin A | Resin B |
|---|---|---|
| BPA-PO[1)] | 2000 g (41.8) | |
| BPA-EO[2)] | 800 g (18.0) | |
| Ethylene Glycol | | 400 g (19.5) |
| Neopentyl Glycol | | 1200 g (34.9) |
| Terephthalic Acid | 600 g (26.5) | 1900 g (34.6) |
| Dodecenylsuccinic Anhydride | 500 g (13.7) | |
| Trimellitic Anhydride | | 700 g (11.0) |
| Softening Point (° C.) | 150.0 | 143.2 |
| Maximum Peak Temperature (° C.) of Heat of Fusion | 66.0 | 67.1 |
| Glass Transition Point (° C.) | 62.3 | 64.9 |

Note) The amounts in parentheses are expressed by a molar ratio in the entire raw material monomer.

[1)]Propylene oxide adduct of bisphenol A (average number of moles added: 2.2 moles).

[2)]Ethylene oxide adduct of bisphenol A (average number of moles added: 2.2 moles).

Examples 1 to 6 and Comparative Examples 1 to 4

A resin binder, a colorant, a charge control agent and a releasing agent, as shown in Table 3, were sufficiently mixed together with a Henschel mixer. Thereafter, the mixture was melt-kneaded using a co-rotating twin-screw extruder (entire length of the kneading portion: 1560 mm; screw diameter: 42 mm; barrel inner diameter: 43 mm), with adjusting the rotational speed of the roller to 200 rpm, a heating temperature within the roller to 100° C., and a feeding rate of the mixture to 10 kg/h. The average residence time of the mixture was about 18 seconds. The resulting melt-kneaded product was cooled and roughly pulverized. Subsequently, the resulting product was pulverized with a jet mill and classified, to give an untreated toner having a number-average particle size of 7.5 μm.

An external additive as shown in Table 3 was added to 100 parts by weight of the resulting untreated toner, and mixed with a Henschel mixer, to give a toner.

Test Example 1

Four grams of a toner was placed in a 20-cc plastic-bottle (commercially available from K.K. Sanplatech), and allowed to stand, with the lid open, under environmental conditions of a temperature of 45° C. and a humidity of 60% for 72 hours. The extent of aggregation of the toner was visually examined, and the storage property was evaluated according to the following criteria. The results are shown in Table 3.

[Evaluation Criteria]

◎: No aggregation being observed;

○: Substantially no aggregation being observed;

Δ: Aggregation being observed; and

X: Entirely aggregated.

Test Example 2

Four parts by weight of a toner and 96 parts by weight of a silicon-coated ferrite carrier (commercially available from Kanto Denka Kogyo Co., Ltd., average particle size: 90 $\mu$m) were mixed for 10 minutes with a turbuler mixer, to give a developer. Next, the resulting developer was loaded in a modified apparatus of a copy machine "AR-505" (commercially available from Sharp Corporation). The development of fixed images was carried out, with sequentially raising the temperature of the fixing roller from 90° to 240° C. The image-bearing sheets used was "CopyBond SF-70 NA" (commercially available from Sharp Corporation, 75 g/m$^2$).

A sand-rubber eraser to which a load of 500 g was applied, the eraser having a bottom area of 15 mm×7.5 mm, was moved backward and forward five times over a fixed image obtained at each fixing temperature. The optical reflective density of the image before or after the eraser treatment was measured with a reflective densitometer "RD-915" manufactured by Macbeth Process Measurements Co. The temperature of the fixing roller at which the ratio of the optical density after the eraser treatment to the optical density before the eraser treatment initially exceeds 70% is defined as the lowest fixing temperature. The low-temperature fixing ability was evaluated according to the following evaluation criteria. The results are shown in Table 3.

[Evaluation Criteria]

◎: A lowest fixing temperature being lower than 130° C.;

○: A lowest fixing temperature being 130° C. or higher and lower than 150° C.; and X: A lowest fixing temperature being 150° C. or higher.

Test Example 3

A developer was loaded in the same apparatus as in the Test Example 2, and solid images were printed out. Subsequently, blank sheet of paper was printed and fixed at 180° C. Lab determination was carried out using "MINOLTA DP-300" (commercially available form MINOLTA CO., LTD.) at a total of 5 points: one point in the middle of a sheet, two points 5 cm from top of the sheet and 5 cm from right and left edges, and two points 5 cm from bottom and 5 cm from right and left edges, to determine ΔE. The extent of generation of the image fogging was evaluated from the obtained value of ΔE according to the following evaluation criteria. The results are shown in Table 3.

[Evaluation Criteria]

◎: ΔE being less than 0.3;

○: ΔE being 0.3 or more and less than 0.6;

Δ: ΔE being 0.6 or more and less than 1.0; and

X: ΔE being 1.0 or more.

TABLE 3

| | Resin Binder | Colorant | Charge Control Agent | Releasing Agent | External Additive | Coating Ratio (%) | Storage Property | Low-Temp. Fixing Ability | Image Fogging |
|---|---|---|---|---|---|---|---|---|---|
| Example | | | | | | | | | |
| 1 | a/A = 20/80 | MOGUL-L = 4 | T-77 = 1 | Carnauba = 1 | TS-530 = 1.5 | 179 | ◎ | ◎ | ◎ |
| 2 | a/A = 20/80 | ECB-301 = 4 | LR-147 = 1 | Carnauba = 1 | TS-530 = 1.5 | 179 | ◎ | ◎ | ◎ |
| 3 | a/A = 20/80 | MOGUL-L = 4 | T-77 = 1 | Carnauba = 1 | TS-530 = 1.5<br>NAX-50 = 1.0 | 202 | ◎ | ◎ | ◎ |
| 4 | a/B = 20/80 | MOGUL-L = 4 | T-77 = 1 | Carnauba = 1 | TS-530 = 1.5 | 179 | ○ | ◎ | ◎ |
| 5 | a/A = 20/80 | MOGUL-L = 4 | T-77 = 1 | Carnauba = 1 | TS-530 = 2.3 | 274 | ◎ | ○ | ○ |
| 6 | a/A = 20/80 | MOGUL-L = 4 | T-77 = 1 | Carnauba = 1 | TS-530 = 1.2 | 143 | ○ | ◎ | ◎ |
| Comparative Example | | | | | | | | | |
| 1 | a/A = 20/80 | MOGUL-L = 4 | T-77 = 1 | Carnauba = 1 | TS-530 = 0.5 | 60 | x | ◎ | ◎ |
| 2 | a/A = 20/80 | MOGUL-L = 4 | T-77 = 1 | Carnauba = 1 | TS-530 = 0.9 | 107 | Δ | ◎ | ◎ |
| 3 | a/A = 20/80 | MOGUL-L = 4 | T-77 = 1 | Carnauba = 1 | TS-530 = 3.0 | 357 | ◎ | ○ | Δ |
| 4 | A = 100 | MOGUL-L = 4 | T-77 = 1 | Carnauba = 1 | TS-530 = 1.5 | 179 | ◎ | x | x |

Note) The used amount is expressed in parts by weight.
MOGUL-L: carbon black, commercially available from Cabot Corporation
ECB-301: blue pigment, commercially available from DAINICHISEIKA COLOR & CHEMICALS MFG. CO., LTD.
T-77: negatively chargeable charge control agent, commercially available from Hodogaya Chemical Co., Ltd.
LR-147: negatively chargeable charge control agent, commercially available from Japan Carlit
Carnauba (Carnauba Wax C1): natural wax, commercially available from K.K. Kato Yoko (melting point: 83° C.)
TS-530: commercially available from Cabot Corporation (average particle size: 8 nm, agent for hydrophobic treatment: hexamethyldisilazane)
NAX-50: commercially available from Nippon Aerosil (average particle size: 40 nm, agent for hydrophobic treatment: hexamethyldisilazane)

It is seen from the above results that the toners of Examples 1 to 6 exhibit an excellent low-temperature fixing ability without impairing the storage property, so that excellent fixed images can be obtained without the image fogging. On the other hand, in Comparative Examples 1 and 2 where the coating ratios with silica are too low, a plasticized crystalline polyester is likely to be exposed to the toner surface, so that the storage property is impaired, and in Comparative Example 3 where the coating ratio with silica is too high, the image fogging is generated due to the reduction in the triboelectric force. Also, in Comparative Example 4 where a crystalline polyester is not contained, the low-temperature fixing ability is poor and the image fogging is generated, nevertheless the coating ratio with silica is of the same level as those of Examples.

According to the present invention, there can be provided a toner which comprises a resin binder comprising a crystalline resin, the toner being excellent in the storage property and the low-temperature fixing ability, and giving a high-quality image without the image fogging.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner comprising:

a resin binder comprising a resin having a ratio of a softening point to a maximal peak temperature of heat of fusion of 0.6 or more and less than 1.1 (hereinafter referred to as "crystalline resin");

a colorant; and fine inorganic particles, said fine inorganic particles being externally added thereto, wherein a coating ratio of said fine inorganic particles on a surface of the toner is 130 to 300%.

2. The toner according to claim 1, wherein the crystalline resin is a crystalline polyester.

3. The toner according to claim 2, wherein the crystalline polyester is obtained by polycondensing an alcohol component comprising 80% by mol or more of an aliphatic diol having 2 to 6 carbon atoms, and a carboxylic acid component comprising 80% by mol or more of an aliphatic dicarboxylic acid compound having 2 to 8 carbon atoms.

4. The toner according to claim 1, further comprising a resin having a ratio of a softening point to a maximal peak temperature of heat of fusion of from 1.1 to 4.0 (hereinafter referred to as "amorphous resin") as the resin binder.

5. The toner according to claim 2, further comprising a resin having a ratio of a softening point to a maximal peak temperature of heat of fusion of from 1.1 to 4.0 (hereinafter referred to as "amorphous resin") as the resin binder.

6. The toner according to claim 3, further comprising a resin having a ratio of a softening point to a maximal peak temperature of heat of fusion of from 1.1 to 4.0 (hereinafter referred to as "amorphous resin") as the resin binder.

7. The toner according to claim 4, wherein the amorphous resin is an amorphous polyester.

8. The toner according to claim 7, wherein the amorphous polyester is obtained by polycondensing an alcohol component and a carboxylic acid component, wherein at least one of the alcohol component and the carboxylic acid component comprises 30 to 100% by mol of at least one member selected from the group consisting of an alkylene oxide adduct of bisphenol A, and alkyl- or alkenyl-substituted succinic acids.

9. The toner according to claim 4, wherein the crystalline polyester has a softening point of from 85° to 150° C., and wherein the amorphous resin has a softening point of from 80° to 170° C.

10. The toner according to claim 4, wherein a weight ratio of the crystalline polyester to the amorphous resin, crystalline polyester/amorphous resin, is from 1/99 to 40/60.

11. The toner according to claim 1, wherein the fine inorganic particles are silica particles.

12. The toner according to claim 1, wherein the fine inorganic particles have an average particle size of from 6 to 200 nm.

13. The toner according to claim 1, wherein the amount of the fine inorganic particles is from 0.7 to 5 parts by weight, based on 100 parts by weight of a toner before the inorganic fine particles are externally added.

* * * * *